US008534384B2

(12) United States Patent
Beuershausen et al.

(10) Patent No.: US 8,534,384 B2
(45) Date of Patent: Sep. 17, 2013

(54) DRILL BITS WITH CUTTERS TO CUT HIGH SIDE OF WELLBORES

(75) Inventors: Chad J. Beuershausen, Magnolia, TX (US); Thorsten Schwefe, Spring, TX (US); Britney E. Meckfessel, Conroe, TX (US); Trung Q. Huynh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 259 days.

(21) Appl. No.: 12/646,431

(22) Filed: Dec. 23, 2009

(65) Prior Publication Data

US 2010/0252327 A1 Oct. 7, 2010

Related U.S. Application Data

(60) Provisional application No. 61/142,081, filed on Dec. 31, 2008.

(51) Int. Cl.
*E21B 7/04* (2006.01)

(52) U.S. Cl.
USPC ..... 175/73; 175/61; 76/108.2

(58) Field of Classification Search
USPC ..... 76/108.2; 175/61, 73
See application file for complete search history.

(56) References Cited

U.S. PATENT DOCUMENTS

| | | | | |
|---|---|---|---|---|
| 2,399,372 | A * | 4/1946 | Metzger et al. | 175/365 |
| 5,339,910 | A | 8/1994 | Mueller | |
| 5,697,461 | A | 12/1997 | Newton et al. | |
| 6,142,250 | A | 11/2000 | Griffin et al. | |
| 7,287,604 | B2 * | 10/2007 | Aronstam et al. | 175/61 |
| 7,802,637 | B2 * | 9/2010 | Aronstam et al. | 175/61 |
| 7,931,098 | B2 * | 4/2011 | Aronstam et al. | 175/61 |
| 7,971,662 | B2 * | 7/2011 | Beuershausen | 175/408 |
| 2005/0056463 | A1 * | 3/2005 | Aronstam et al. | 175/61 |
| 2008/0041629 | A1 * | 2/2008 | Aronstam et al. | 175/61 |
| 2008/0053705 | A1 * | 3/2008 | Aronstam et al. | 175/61 |
| 2010/0303570 | A1 * | 12/2010 | Denoix et al. | 408/227 |

* cited by examiner

*Primary Examiner* — William P Neuder
*Assistant Examiner* — Catherine Loikith
(74) *Attorney, Agent, or Firm* — Cantor Colburn LLP

(57) ABSTRACT

A drill bit in one aspect includes a cutting device on a selected section of the drill bit, which cutting device is configured to cut formation on the high side of a wellbore during drilling of the wellbore. In one aspect, the cutting device comprises a cutting element disposed on a substantially non-rotating member placed around the selected section. In another aspect, the selected section may be a gage section of the drill bit.

19 Claims, 4 Drawing Sheets

DRILL BITS WITH CUTTERS TO CUT HIGH SIDE OF WELLBORES

CROSS-REFERENCE TO RELATED APPLICATION

This application claims priority from the U.S. Provisional patent application having the Ser. No. 61/142,081 filed Dec. 31, 2008.

BACKGROUND INFORMATION

1. Field of the Disclosure

This disclosure relates generally to drill bits and systems that utilize the same for drilling wellbores.

2. Background of the Art

Oil wells (also referred to as "wellbores" or "boreholes") are drilled with a drill string that includes a tubular member that conveys a drilling assembly (also referred to as the "bottomhole assembly" or "BHA") attached to its bottom end into the wellbore. The BHA typically includes devices and sensors that provide information about a variety of parameters relating to the drilling operations ("drilling parameters"), behavior of the BHA ("BHA parameters") and the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. For drilling deviated wellbores, often it is desirable to cut the formation at high build rates. Build rates are typically achieved by mechanisms or devices that are uphole of the drill bit. Higher build rates may be achieved by including one or more devices in the drill bit. The present disclosure provides drill bits with one or more devices in the drill bit to form deviated wellbores.

SUMMARY

The disclosure herein, in one aspect, provides a drill bit that includes a cutting device above or uphole of the conventional cutters on the drill bit to cut the high side of the wellbore during drilling of a wellbore. In one aspect, the cutting device may be placed on a non-rotating member arranged around the drill bit body. In another aspect, the non-rotating member may be placed around a gage section of the drill bit. The cutting device may include cutters suitable for cutting into the formation along a side of the drill bit. A suitable actuation device, may be used to actuate the cutting device, which may include, but is not limited to, a hydraulic device, an electric motor, an electro-mechanical device and a mechanical device. A controller may be provided to control the operation of the actuation device during drilling of the wellbore. Sensors may be provided to determine the high side of the wellbore and the controller may be configured to cause the cutting device to orient or align along the high side of the wellbore.

In another aspect, the disclosure provides a method for drilling a wellbore that in one aspect may include: conveying a drill bit having cutters on a face section of the drill bit and a cutting device on a side of the drill bit; cutting a formation in front of the drill bit by rotating the face section of the drill bit; orienting the cutting device along a high side of the wellbore; and cutting the formation along the high side of the wellbore using the cutting device. The method may further include determining the high side from a sensor measurement and orienting the cutting device in response to the sensor measurement. The sensor measurements may include measurements from one or more accelerometers and/or one or more magnetometers.

In another aspect, a method of making a drill bit is disclosed that in one aspect may include: providing a drill bit configured to form a wellbore; providing a cutting device on a side of the drill bit configured to cut formation on a high side of the wellbore. The method of making the drill bit may further include providing the cutting device on a substantially non-rotating member around the drill bit. In another aspect, the method may further include providing an actuation device configured to rotate the cutting device. In another aspect, the method may further include providing a controller to orient the cutting device along the high side of the wellbore during drilling of the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
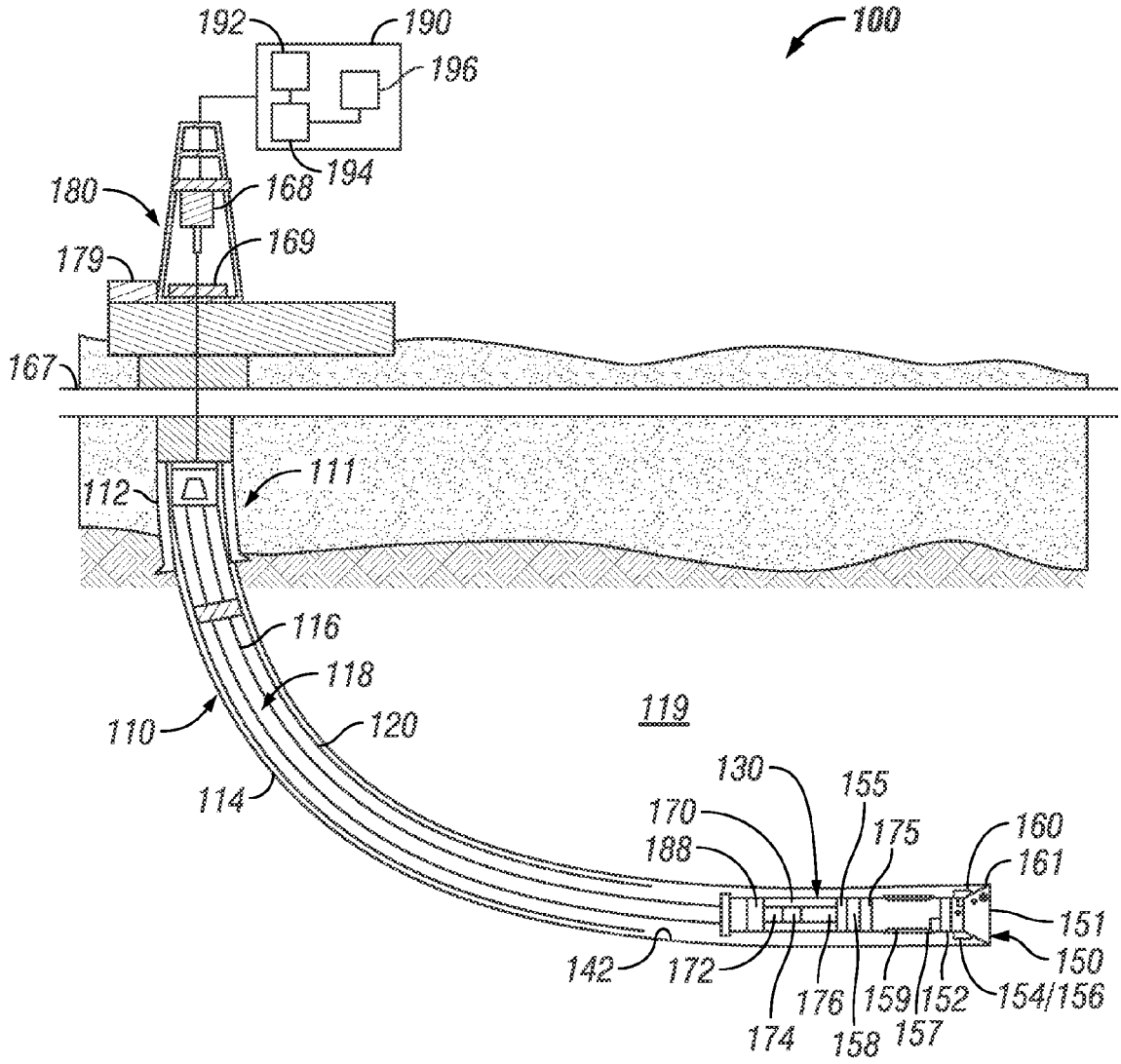
FIG. 1 is a schematic diagram of an exemplary drilling system that includes a drill string with a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be a coiled-tubing or made by joining drill pipe sections. A drill bit 150 is attached to the bottom end of the BHA 130 for cutting the rock formation 119 to drill the wellbore 110.

Drill string 118 is shown conveyed into the wellbore 110 from an exemplary rig 180 at the surface 167. The exemplary rig 180 shown is a land rig for ease of explanation. The apparatus and methods disclosed herein may also be utilized with an offshore rig (not shown) used for drilling wellbores under water. A rotary table 169 or a top drive 168 coupled to the drill string 118 may be utilized to rotate the drill string 118, BHA 130 and the drill bit 150 to drill the wellbore 110. A drilling motor 155 (also referred to as the "mud motor") may be provided in the BHA 130 to rotate the drill bit 150. The drill bit may be rotated by the drilling motor 155 or by rotating the drill string 118 or by both the drilling motor and the drill string rotation. A control unit (or controller) 190, which may be a computer-based unit, may be placed at the surface 167 to receive and process data from the sensors in the drill bit 150 and the sensors in the BHA 130 and to control selected operations of the various devices and sensors in the BHA 130. The surface controller 190, in one embodiment, may include a processor 192, a data storage device (or a computer-readable medium) 194 for storing data, algorithms and computer programs 196 accessible to the processor 192. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space 120 (also referred as the "annulus") between the drill string 118 and the inside wall 142 of the wellbore 110.

Still referring to FIG. 1, the drill bit 150 includes cutters 151 at selected locations on the drill bit that are configured to cut into the formation 119. The drill bit 150 also includes a gage section 152 that is substantially parallel to the longitudinal axis of the drill bit 150. In one aspect, a cutting device 160 is provided in the drill bit above or uphole of the cutters 151 to cut the formation on a high side of the drill bit. In one aspect, the cutting device 160 may include a substantially non-rotating member or sleeve 154 placed around the gage section 152 and one or more cutters 156 on the non-rotating member 154. An actuation device 157 disposed in the drill bit and/or in the BHA 130 may be utilized to operate the cutters 156. Devices and sensors 158 may be provided in the BHA to determine the inclination, azimuth and tool face of the BHA 130. A controller 170 in the BHA may be configured to use data from sensors 158 to determine the tool face and high side of the BHA 130 during drilling of the wellbore 110. The controller 170 or another controller within or outside the drill bit 150 may be utilized to control the operation of the actuation device 157 to drill the wellbore along the high side of the wellbore while drilling of the wellbore. In operation, the controller 170 orients the cutting device 160 along the high side 161 of the wellbore 110 and controls the actuation device 157 and thus the cutting device 160 to cut the formation on the high side 161 of the wellbore 110. The actuation device 157 may be any suitable device, including, but not limited to, a hydraulic device, an electrical device, and a mechanical device. One or more actuation devices 159 may be provided to articulate the BHA and thus the drill bit to drill the wellbore with a selected build rate along a desired curved path. The actuation device 159 may include force application members (ribs) and/or knuckle joints. Cutting the formation along the high side 161, in one aspect, may increase the build rate of drilling of the wellbore 110.

Still referring to FIG. 1, the BHA 130 may further include one or more downhole sensors (collectively designated by numeral 175). The sensors 175 may include any number and type of sensors, including, but not limited to, sensors generally known as the measurement-while-drilling (MWD) sensors or logging-while-drilling (LWD) sensors, and sensors that provide information relating to the behavior of the BHA 130 and the drill bit 150, such as drill bit rotation speed (revolutions per minute or "RPM"), pressure, vibration, whirl, oscillation, bending, stick-slip and formation type. Sensor 158 may be provided to determine the tool face and high side of the wellbore. The controller 170 may be configured to control the operation of the actuation device 157 and to at least partially process data received from the sensors 158 and 175. The controller 170 may include circuits configured to process the sensor 175 signals (e.g., amplify and digitize the signals), a processor 172 (such as a microprocessor) configured to process the digitized signals, a data storage device 174 (such as a solid-state-memory), and computer programs 176 accessible to the processor 172. The processor 172 may process the digitized signals, control the operation of the actuation device 157, process data from sensors 158 and 175, control the operations of the sensors 175 and other downhole devices, and communicate data information with the controller 190 via a two-way telemetry unit 188. The controller 170, in one aspect may control the actuation device 157 to control the cutting action of the cutting device 160 in response to one or more parameters of interest, including, but not limited to, rate of penetration (ROP), vibration, stick-slip, whirl, oscillation, bending moment, torque, rock type, and desired build rate, based on the programmed instructions stored in the data storage device 174 and/or instructions sent by the surface controller 190. Such adjustments may be made in-situ. Adjusting or altering the cutting device 160 operation (for example speed) may provide a desired build rate along with a smoother wellbore and extended drill bit life.

Figure 2:
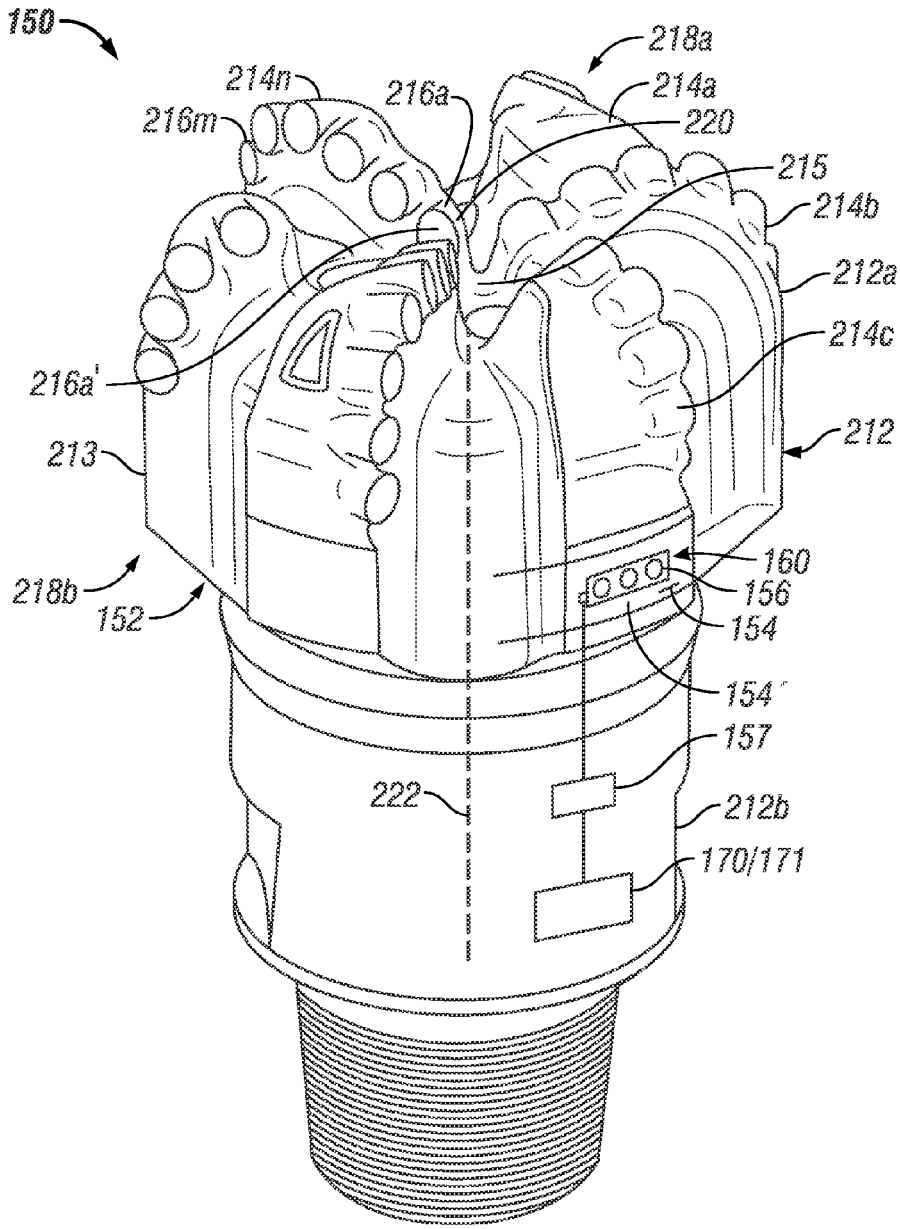
FIG. 2 shows an isometric view of a drill bit made according to one embodiment of the disclosure.
Figure 3:
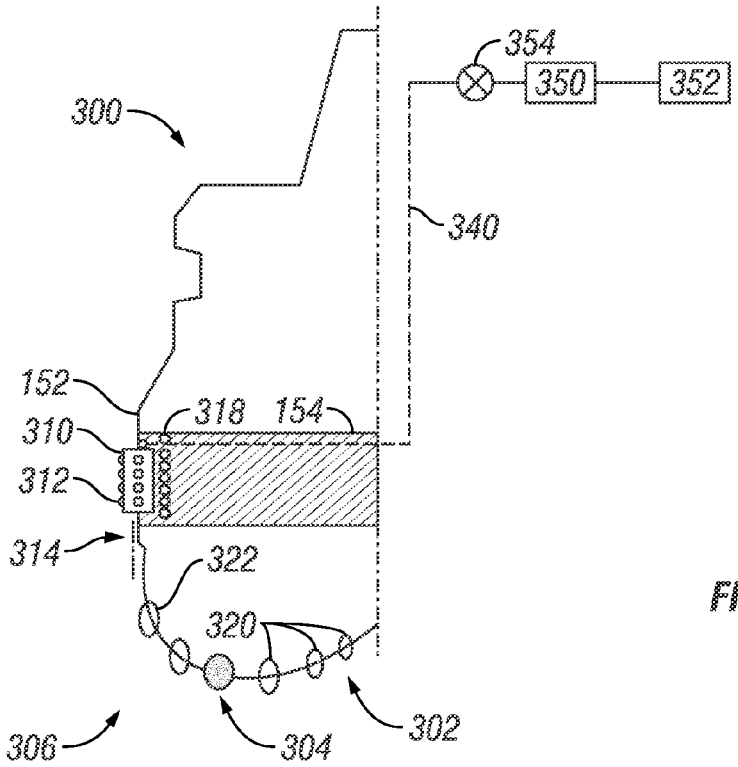
FIG. 3 is a schematic illustration of a blade profile of the drill bit shown in FIG. 2 that includes a cutting device on the gage section of the drill bit.

FIG. 2 shows an isometric view of a drill bit 150 made according to one embodiment of the disclosure. The drill bit 150 shown is a polycrystalline diamond compact (PDC) drill bit having a bit body 212 that includes a cutting section 212*a* and shank 212*b* that connects to a BHA 130. The cutting section 212*a* includes a face section 218*a* (also referred to herein as the "bottom section"). For the purpose of this disclosure, the face section 218*a* may comprise a nose, cone and shoulder as shown in FIG. 3. The cutting section 212*a* is shown to include a number of blade profiles 214*a*, 214*b*, . . . 214*n* (also referred to as the "profiles"). Each blade profile includes cutters on the face section 218*a*. Each blade profile terminates proximate to a drill bit center 215. The drill bit center 215 faces (or is in front of) the bottom of the wellbore 110 ahead of the drill bit 150 during drilling of the wellbore. The drill bit includes a side portion 213, generally referred to as the gage section, that is substantially parallel to the longitudinal axis 222 of the drill bit 150. A number of spaced-apart cutters are shown placed along each blade profile. For example, blade profile 214*n* is shown to contain cutters 216*a*-216*m*. Each cutter has a cutting surface or cutting element, such as cutting element 216*a*' for cutter 216*a*, that engages the rock formation when the drill bit 150 is rotated during drilling of the wellbore. Each cutter 216*a*-216*m* is configured with a back rake angle and a side rake angle that, in combination, define the depth of cut of the cutter into the rock formation.

The drill bit 150 of FIG. 2 is further shown to include a non-rotating member 154 placed in a cavity 154' made in the gage section 213. A cutting device 160 having one or more cutters or cutting elements 156 is shown placed on or carried by the non-rotating member 154. An actuation device 157 is operatively coupled to the cutting device 160 and activates the cutting members 156. A controller 170/171 disposed at a suitable location controls the operation of the actuation device 157.

FIG. 3 is a schematic illustration of a blade profile 300 of drill bit 150 shown in FIG. 2. The blade profile 300 includes a nose section 302, cone section 304, shoulder section 306 and gage section 152. Each of these sections may have cutting elements 320 thereon for cutting the formation. In one configuration, a non-rotating member 154 is placed around the periphery of the gage section 152 above or uphole of any gage cutters, such as cutter 322. A cutting device 310 is placed on the non-rotating member 154. One or more cutters 312 are disposed in the cutting device 310. In one aspect, the cutting device 310 may be configured to rotate about an axis 314 by a prime mover, such as a fluid under pressure supplied by an actuation device 350. In one aspect, the actuation device 350 may supply fluid 352 under pressure to the cutting device 310 via a fluid channel 340. A control valve 354 placed in the fluid channel 340 may control the flow of the fluid from the actuation device 350 to the cutting device 310. The actuation device 350, in one aspect, may include a pump or turbine operated by the drilling fluid flowing through the drill bit or electrically-operated by motor. The fluid 352 may be the drilling fluid 179 (FIG. 1) flowing through the drill bit center. Bearings 318 may be provided to facilitate the relative motion of the non-rotating member 154 with respect to the rotating gage section 152. For the purpose of this disclosure a non-rotating member is a member that is able to remain stationary or substantially stationary relative to the borehole when the drill bit is rotating so that a cutting device thereon is able to cut the formation along a selected wellbore section during drilling of the wellbore.

Figure 4:
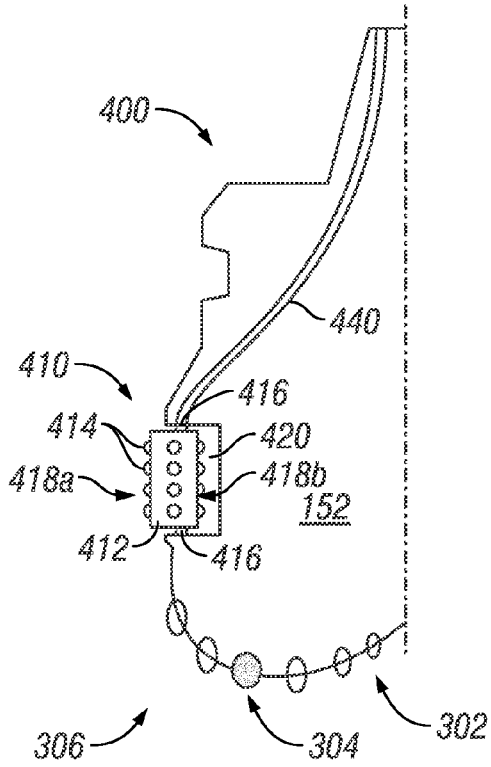
FIG. 4 is a schematic illustration of a blade profile shown in FIG. 2 that includes a cutting device in a notch or cavity formed in the gage section of the drill bit.

FIG. 4 is a schematic illustration of a blade profile 400 of drill bit 150 shown in FIG. 2 that includes a cutting device 410 in a notch or cavity 420 formed in the gage section 152 of the drill bit 150. The cutting device 410, in one configuration, may include a rotating member 412 configured to rotate about pivot points 416 in the cavity 420. The rotating member 412 may be a cylindrical element or a roller that includes cutting elements 414 thereon configured to cut the formation. The cutting elements 414 may be arranged in any manner, including in rows 418*a*, 418*b*, etc. around the rotating member 412. The rotating 412 may be a powered member or a non-powered member. Power may be provided by a fluid under pressure via a fluid channel 440 in a manner similar to as described in reference to FIG. 3. In another aspect, the rotating member 412 may be rotated by an electrical device, such as a motor.

Figure 5:
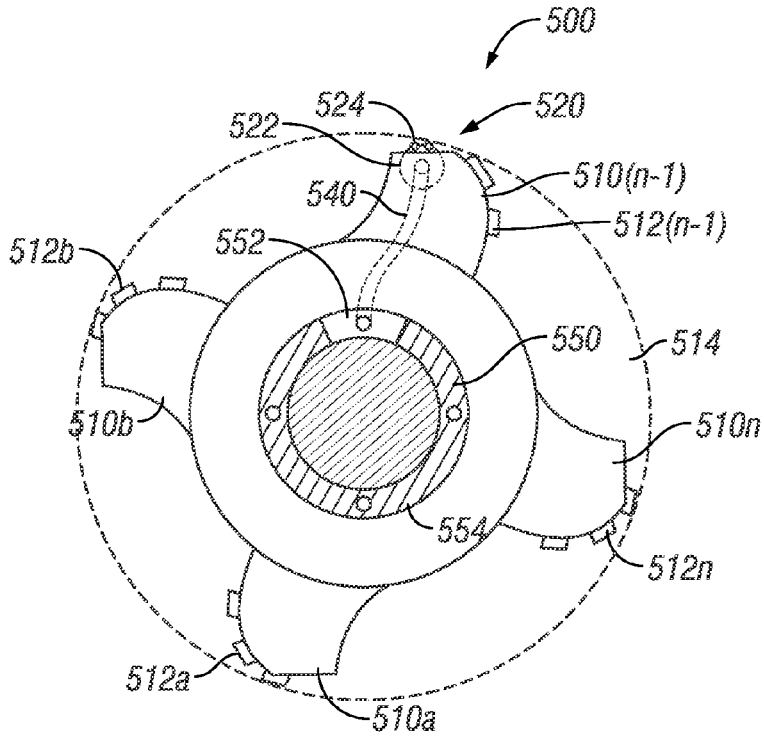
FIG. 5 is a schematic illustration of a cross-section of a drill bit that includes a cutting device on a gage section of the drill bit.

FIG. 5 is an illustration of a cross-section of a drill bit 500 that includes a cutting device 520 on a gage section of the drill bit. The drill bit 500 includes blade profiles 510*a*-510*n* respectively carrying cutting elements 512*a*-512*n*. One cutting device 520 on the gage section includes a rotating member 522 carrying cutting elements 524. The outer diameter of the gage section is shown by dotted circle 514. In one aspect, a flow orienting device 550, such as a flow orienting ring, may be utilized to supply a fluid under pressure to the cutting device 520. The flow orienting device 550, in one aspect, may include an open fluid flow section 552 that during drilling orients along a fluid channel 540 to supply the fluid to the cutting device 520. Other sections 554 of the flow orienting device 550 are closed.

Figure 6:
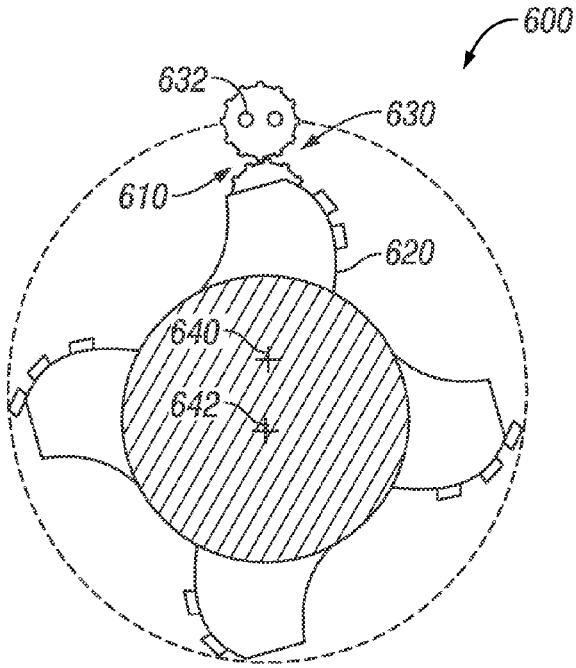
FIG. 6 shows a schematic illustration of a cross-section of a drill bit that includes a cam-type rotation cutting device.

FIG. 6 shows a cross-section view 600 of a drill bit that includes a cam-type rotation cutting device 610 for cutting the formation on the high side of wellbore. The cutting device 610 is placed on a sleeve around the drill bit 600. The cutting device 610 may include a first rotating member 620 that rotates a second member 630 that has cutters 632 thereon. The members 620 and 630 may include interlocking teeth or gears. Power to the member 620 may be provided by a fluid under pressure or by an electrical motor. When the cutting element 630 is engaged with the formation, the center 640 of the sleeve carrying the cutting device may be offset from the center 642 of the drill bit, as shown in FIG. 6.

Thus, in one aspect, a drill bit is disclosed that in one configuration may include a cutting device or cutters placed on a selected section of the drill bit, which cutting device is configured to cut formation surrounding the drill bit along a high side of the formation during drilling of a wellbore. In one aspect, the selected section may be the gage section of the drill bit or another suitable location. In another aspect, the cutting device may comprise a cutting element disposed on a non-rotating member placed around the selected section. A suitable actuation device may be configured to supply power to the cutting device. Any suitable actuation device may be utilized for the purpose of this disclosure, including, but not limited to: a mechanical device; a hydraulic device; an electrical device; and an electro-mechanical device. In another aspect any suitable cutting device may be used, including, but not limited to devices containing: a rotor having one or more cutting elements thereon placed on a non-rotating sleeve around a gage section of the drill bit; a cam-type rotation device having cutters thereon; and a rotor having cutters thereon disposed in a cavity on a gage section of the drill bit. In another aspect, a controller in the drill bit and/or in a BHA may be utilized to control power to the cutting device. The controller may be configured to orient the cutting device along a high side of the wellbore before activating the cutting device.

In another aspect, a method for drilling a wellbore is provided, which may include: drilling a wellbore by a drill bit; and cutting a formation on a high side of the wellbore to obtain a desired build rate. The method may further include orienting a cutting device on the drill bit to the high side of the wellbore and activating the cutting device to cut the formation on the high side of the wellbore. The method may further include orienting the cutting device along the high side before cutting the formation on the high side of the wellbore.

The disclosure herein describes particular configurations of cutting devices on a side of a drill bit. Any suitable cutting device configured to cut the formation along the high side of the wellbore, however, may be utilized for the purpose of this disclosure. Also, any suitable device or method may be utilized to power the cutting devices.

The invention claimed is:

1. A drill bit, comprising:

a cutting device placed on a substantially non-rotating sleeve of the drill bit, wherein the cutting device is configured to cut a formation surrounding the drill bit; and an actuation device configured to actuate the cutting device when the cutting device is along a high side of a wellbore to obtain a desired build rate.

2. The drill bit of claim 1, wherein the substantially non-rotating sleeve comprises a gage section of the drill bit.

3. The drill bit of claim 1, wherein the cutting device comprises a cutting element disposed on a substantially non-rotating member placed around the selected section.

4. The drill bit of claim 1, wherein the actuation device is configured to supply power to the cutting device.

5. The drill bit of claim 4, wherein the actuation device is selected from the group consisting of: a mechanical device; a hydraulic device; an electrical device; and an electro-mechanical device.

6. The drill bit of claim 1, wherein the cutting device comprises a rotor having one or more cutting elements thereon placed on the substantially non-rotating sleeve.

7. The drill bit of claim 1, wherein the cutting device comprises a cam-type rotation device having cutters thereon.

8. The drill bit of claim 1, wherein the cutting device comprises a rotor having cutters thereon disposed in a cavity on a gage section or another side section of the drill bit.

9. The drill bit of claim 1 further comprising a controller configured to determine a high side of the wellbore and to control supply of power to the cutting device.

10. The drill bit of claim 1, wherein the cutting device comprises a rotating device having cutters thereon that is actuated by the actuation device to cut the formation proximate the high side of the wellbore.

11. A method of drilling a wellbore into a formation, comprising:

drilling a wellbore with a drill bit having a cutting device on a substantially non-rotating sleeve on a side of the drill bit; and activating the cutting device when the cutting device is along a high side of the wellbore to cut the formation along the high side of the wellbore to obtain a desired build rate.

12. The method of claim 11, wherein cutting the formation comprises orienting the cutting device on the drill bit to the high side of the wellbore.

13. The method of claim 12, wherein activating the cutting device comprises supplying power to the cutting device when the cutting device is oriented toward the high side of the wellbore.

14. The method of claim 12 further comprising determining the high side from a sensor measurement.

15. The method of claim 11 further comprising:

conveying the drill bit into the wellbore, wherein the drill bit includes cutters on a face section of the drill bit; and cutting a formation in front of the drill bit by rotating the face section of the drill bit.

16. The method of claim 11, wherein cutting the formation comprises using a cutting element disposed on the non-rotating member.

17. A method of making a drill bit, comprising:

providing a drill bit configured to form a wellbore;

providing a cutting device on a substantially non-rotating sleeve on a side of the drill bit configured to cut a formation on a high side of the wellbore; and providing an actuation device configured to actuate the cutting device when the cutting device is along the high side of the wellbore.

18. The method of claim 17, wherein the actuation device is configured to rotate the cutting device.

19. The method of claim 17 further comprising providing a controller to orient the cutting device along the high side of the wellbore during drilling of the wellbore.

* * * * *